United States Patent [19]

Brown, Jr. et al.

[11] Patent Number: 4,803,792

[45] Date of Patent: Feb. 14, 1989

[54] FIREARM CLEANING DEVICE

[75] Inventors: Leland C. Brown, Jr., Pittsburgh; Neil A. Jones, Saegertown, both of Pa.; Ferris Pindell, Connersville, Ind.

[73] Assignee: U.S. Products Co., Pittsburgh, Pa.

[21] Appl. No.: 114,060

[22] Filed: Oct. 29, 1987

[51] Int. Cl.[4] ..... F41C 31/00

[52] U.S. Cl. ..... 42/95; 15/104.05

[58] Field of Search ..... 42/95, 96; 15/104.05, 15/104.09, 104.16

[56] References Cited

U.S. PATENT DOCUMENTS

| | | | |
|---|---|---|---|
| 430,767 | 6/1890 | Brady | 15/104.16 |
| 799,125 | 9/1905 | Whinery | 15/104.16 |
| 1,133,571 | 3/1915 | Nieder | 42/95 |
| 2,409,916 | 9/1943 | Varcoe | 15/104.16 |
| 2,544,847 | 3/1951 | Malesky | 15/104.16 |
| 2,877,484 | 3/1959 | Taylor et al. | 42/95 |
| 3,286,293 | 11/1966 | Eckert | 42/95 |
| 4,674,218 | 6/1987 | Bottomley | 42/95 |

*Primary Examiner*—Deborah L. Kyle
*Assistant Examiner*—Michael J. Carone
*Attorney, Agent, or Firm*—Parmelee, Miller, Welsh & Kratz

[57] ABSTRACT

A gun cleaning device is provided that is adaptable for guns having different sizes and gauges of barrels and that can be securely mounted in an operating position at the breech end of a gun barrel for a highly accurate and improved movement of its rod-carrying, end-mounted, bore cleaning element which element is wholly retained within the gun bore. The device greatly minimizes wear and tear on the bore and its lands during a cleaning operation. Its rod is guidably positioned in a carrier sleeve which, at its front end, cooperates with a breech mounting plug to loosely limit its sidewise movement and which at its back end cooperates with a close-clearance-defining bore of a plug-like guide sleeve. The rod also has a rotatable, back-end-mounted grip handle that permits turning movement of the rod and the bore cleaning element with lands of the gun rifling. The breech mounting plug limits the maximum backward movement of the rod and a stop shoulder on the rod in cooperation with the guide sleeve limits the maximum forward movement of the rod. A position retention sleeve cooperates with the breech mounting plug to retain the device in a secure operating position during the gun bore cleaning operation.

19 Claims, 2 Drawing Sheets

FIREARM CLEANING DEVICE

This invention relates to an improved gun cleaning rod which is constructed to minimize wear and tear on the lands of rifling in the bore of a gun barrel. We have found that 90% of the destruction of gun rifling is due to wear and tear on it from the use of cleaning rods. Heretofore, it has been considered that about 1500 to 1600 rounds of ammunition represents the normal life of the bore. We have been able to effectively increase the life, employing our present invention, to about 7000 rounds before replacement is required. This is accomplished by an improved cleaning rod construction which protects gun bore rifling incident to cleaning operations that are necessary to keep the gun barrel free from powder, dirt and metal particle contamination. It has thus been an object of the invention to solve the problem of excessive wear on the rifling of gun barrels that has before resulted from cleaning operations.

Another object has been to discover the basic reason for such wear and tear and to provide an improved cleaning rod device based on such discovery.

Another object has been to provide a smoothly and positively operating construction that will minimize wear and tear on the rifling of gun bores and to thus extend its life.

A further object has been to provide a cleaning rod device that can be secured in a best possible and stable operating position during a gun cleaning operation.

These and other objects will appear to those skilled in the art in view of the herein disclosed embodiment and the claims.

Figure 1:
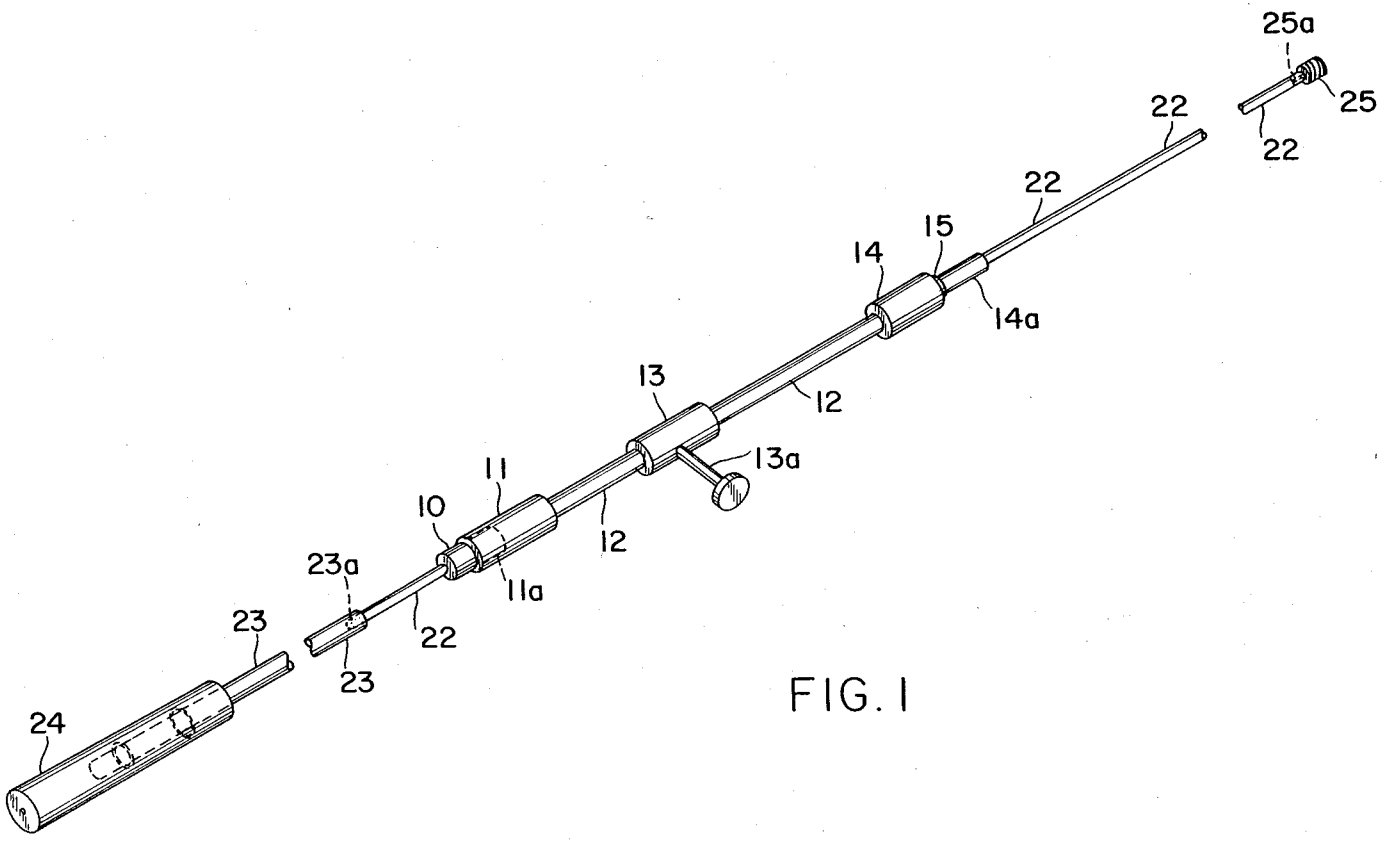
Figure 2:
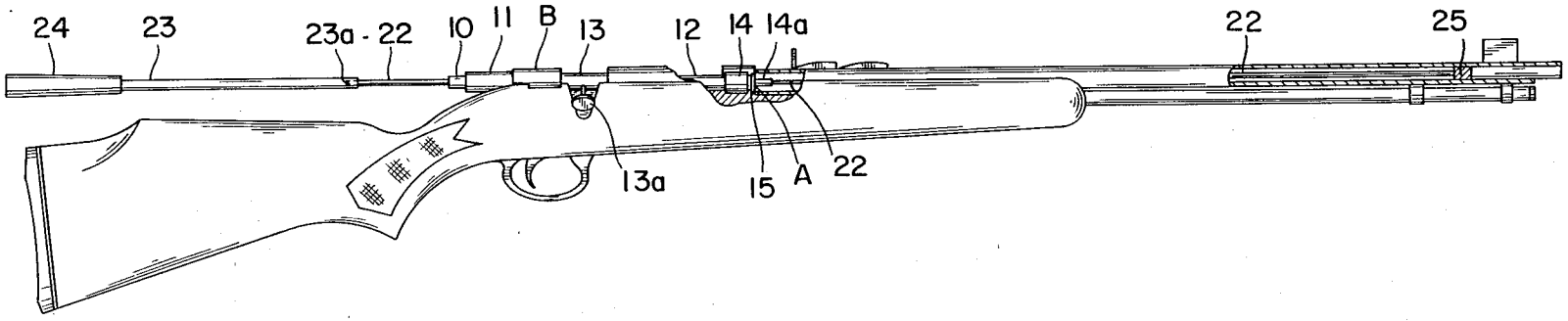

In the drawings, FIG. 1 is a side perspective view in elevation of a gun cleaning rod construction in accordance with our invention;

And, FIG. 2 is a side view in elevation showing the rod construction of FIG. 1 in a representative securely mounted operating position with respect to a bolt action rifle.

Heretofore, the conventional cleaning rod has consisted of a somewhat flexible metal rod having a suitable length and a set of conditioning or cleaning elements, such as a brush, a cloth-like swab, and a cloth strip receiving eye loop that can be threadably removably mounted on a front end of the rod. The rod may also have a handle non-rotatably mounted on its back end and will have a length that is greater than the length of the gun barrel to be cleaned. This type of rod is customarily introduced into the open mouth or muzzle of the gun bore and then reciprocated back and forth along the bore and, often, during the cleaning movement, dropping its brush or the cleaning end portion out of one end of and thus requiring its continued re-insertion into the bore. Reciprocating movement is effected to clean-out the powder and bullet lead refuse, etc., and to then provide the bore with a coating of a protective gun oil, grease or solution. This somewhat oscillatory motion of the rod, from time to time, tends to cause metal portions of the rod to hit and rub against the rifle bore and particularly, at its muzzle. There have also been flexible or spring-like, coil-shaped rod constructions which exaggerate the above type of adverse cleaning action. See the Malesky U.S. Pat. No. 2,544,847.

In order to prevent "rubbing" of his rod on the gun bore, Varcoe (U.S. Pat. No. 2,409,916 ) provided a core-shaped, plug-like means for frictional mounting within either the breech or the muzzle of a gun. In doing so, in an attempt to prevent rod contact or rubbing with the gun bore he failed to perceive the need for a positively positioned, mounting guide assembly which will not only maintain a slide clearance of the rod with respect to the gun bore, but which will positively position and retain the cleaning device during the cleaning operation, which will assure a breech only operation, which will enable a free rotative movement of the bore cleaning element during its back and forth movement along the gun bore, and whose rod will have a smooth and easy reciprocating movement as assured by a close clearance defining element having a backwardly spaced relation with respect to the gun bore in cooperation with a bore breech positioned, somewhat loose clearance defining element.

In accordance with the invention, our cleaning device assembly will be positively and securely held in a breech-mounted operating position, and the length of the rod will have and be retained in a close clearance defining relation during its manually engendered back and forth movement along the gun bore by a pair of endwise spaced-apart, slide supports, as represented at one end portion by the cleaning or conditioning element and at the other end portion by a remotely positioned, sleeve-like guide plug.

In the embodiment of the invention shown in FIG. 1, we have provided a longitudinally extending, substantially rigid central section or cleaning rod 22, such as of steel or other suitable, substantially rigid metal or material, and which will have a suitable length for the particular gun that is to be cleaned, whether it is a rifle or a handgun. The device shown is of particular importance from the standpoint of a gun, such as a rifle, having a relatively long length of barrel from the standpoint of minimizing wear and tear on its barrel and rifling. The rod 22 is of solid construction and, at its back end, is shown connected to a rod-like handle section 23 of slightly enlarged diameter that is removably, endwise secured thereto by a threaded male and female connection 23*a*. A grip handle 24 is rotatably securely mounted or journaled on the back end portion of the rod section 23 and may be of a plastic or resin construction. It is contemplated that the rod section 22 will be replaceable to accommodate it to the length of the bore of the gun that is to be cleaned. The front end of the rod 22 has a threaded male and female connection 25*a* to removably receive and secure a suitable brush, slotted rag-receiving or felt plug, bore cleaning or conditioning element 25 in a securely mounted relation thereon.

In accordance with the invention, a longitudinally extending carrier sleeve 12, slidably, rotatably receives and passes the rod 22 therethrough with a spacing which is in a somewhat loose, clearance type with respect thereto. The sleeve 12, in combination with the shoulder defined between rods 22 and 23 importantly directly serves to limit the extent of forward movement of the conditioning element or part 25 to the length or extent of the barrel bore rifling. A relatively short length rear positioning sleeve 11 which may be of plastic material is, at its front end secured on a back end portion of the carrier sleeve 12 and has an open back end mouth portion 11*a* of a diameter to removably-slidably receive a plug-like rod guide sleeve 10 therein that may also be of plastic material. The guide sleeve 10 will have a slide bore provided with a close, clearance defining relation (e.g. 0.001 inch) with respect to the rod 22 to serve as a remotely located alignment device for the rod 22 during its back and forth gun cleaning operation and, as a spacing maximized, end alignment guide with the conditioning element or part 25. The guide sleeve 10 serves as an intermediate stop means for limiting the maximum forward movement of the cleaning rod section 22. Since the sleeve 10 is removable, it may be provided in different lengths to accommodate slightly different lengths of gun bores without charging the length of the rod 12, itself.

The length of the carrier sleeve 12 will preferably be sufficient to extend along breech A of the gun (see FIG. 2) and backwardly outwardly beyond its cross bridge B. The front end of the carrier sleeve 12 has a breech mounting plug 14 which may be of plastic material, secured thereon to extend forwardly thereof. A front end portion 14*a* will be provided with a reduced outer diameter such as to slidably fit within the smooth bore breech end portion of the bore of the gun to be cleaned. The end portion 14*a* carries an O-ring gasket 15 that is adapted to abut the breech end of the gun barrel as shown in FIG. 2. The bore of the breech plug end portion 14*a* will be sufficient (e.g. 0.006 inch) to provide a relatively wide clearance spacing with respect to the rod 22 to facilitate a relatively minimized frictional guide spacing for the rod 22 during its back and forth movement; it may be of a relatively hard plastic material of the same type as sleeve 11 and a position retention sleeve 13.

The position retention plug 13 is slidably positioned on the carrier sleeve 12 to securely hold the assembly in an operating position such as shown in FIG. 2. It has a set screw 13*a* for securing or locking it against the inner side of the bridge B of the gun to thus retain the breech plug 14 in its forwardly abutting-mounted position with respect to the breech end of the gun, as shown. It will also be noted from FIG. 2 of the drawings that the set screw 13 *a* has a slightly extending stem portion which enables it to be moved into a locking relation with respect to the notch in the stock of a bolt action gun by partially rotating the sleeve 13. This device positioning may thus be positively retained during a full reciprocating cleaning of a gun bore by the rod 22 and its element 25. In this Figure, the gun's bolt has been removed in order to attain the above described mounting of the cleaning device.

The rotatable mounting of the handle 24 enables the rod 22 to freely turn or rotate during its easy back and forth movement such that the conditioning element 25 may follow the lands of the gun bore. The loose fit of the rod 22 within the bore of the plug portion 14*a* prevents any binding during the cleaning operation, but is such as to prevent any side slap of the rod 22 within the gun barrel. On the other hand, the close, clearance defining relation of guide plug 10 with respect to the rod 22 and close cleaning relation of the element 25, serve in combination as spaced-apart means that prevents any contact of the rod length 22 with the gun bore during the cleaning operation.

Thus in accordance with the preferred embodiment of the construction, the portion of 14*a* which enters the breech end of the bore of a rifle has a slightly enlarged bore as will the bore of the carrier sleeve 12 to facilitate limited movement of the rod 22 during its back and forth cleaning operation, as manually effected by the handle 24. On the other hand, the short length guide sleeve 10 has a close clearance relation with respect to the rod such that it serves as an accurate back support for the rod during its movement and in cooperation with the bore engaging front-mounted cleaning element or part 25.

The device has been found to lengthen the life of a gun bore by reason of its favorable construction. In the first place, it is only entered into and is operated from the breech end of the guns bore. In the second place, its carrier sleeve 12 is, in effect, positively retained in a fixed positioning between the breech end A of the barrel and the bridge B behind the bolt opening of the gun. A slight, free sway of the rod during its back and forth movement is permitted by reason of the slightly enlarged diameter of the carrier sleeve 12 and the bore-mounting front end plug portion 14*a*, while an absolute accuracy of movement is attained between two, end-spaced portions of the rod by the cleaning or conditioning element 25 and the removable guide plug 10.

We claim:

1. An improved cleaning rod device for entry into the bore of the barrel of a gun from its breech end which comprises, a longitudinally extending substantially rigid cleaning rod, a bore conditioning element adapted to be mounted on a front end of said rod for entry into the breech end of a gun bore, a substantially rigid longitudinally extending carrier sleeve adapted to relatively loosely slidably receive said rod for back and forth sliding movement therealong, a breech mounting front plug secured on a front end portion of said carrier sleeve and having a front end portion for entry into the gun barrel from its breech end and having a back end portion of enlarged diameter for abutment with the breech end of the gun barrel, said front end portion of said breech mounting front plug having a through-extending bore for slidably by-passing said rod therethrough, a rear positioning sleeve secured on a terminating back end portion of said carrier sleeve and having a back end mouth portion, a guide sleeve carried by the back end mouth portion of said positioning sleeve and having a relatively close sliding relation on said rod to guide said rod during its back and forth movement within said carrier sleeve, means cooperating with said carrier sleeve to positively retain said breech mounting plug in an abutting position with respect to the breech of a gun to be cleaned, and said rod being adapted to be moved back and forth along said breech mounting plug and said carrier sleeve and in a guided relation within said guide sleeve for cleaning a bore of the gun.

2. An improved cleaning rod device as defined in claim 1 wherein said guide sleeve has a rod receiving bore therethrough that defines a close-clearance-guiding relation with said rod, the front end portion of said breech mounting plug is of a reduced diameter for entry into the breech end of the gun barrel, and said breech mounting plug has a relatively wide clearance spacing with respect to said rod.

3. An improved cleaning rod device as defined in claim 1 wherein, said means is a position retention sleeve slidably mounted on said carrier sleeve between said breech mounting plug and said rear plug, and said position retention sleeve has means for securing it in an abutting position with respect to a bridge portion of the gun to be cleaned.

4. An improved cleaning rod device as defined in claim 1 wherein, said rod is maintained in a close-clearance-guided relation by and between said guide sleeve and said bore conditioning element, and said carrier sleeve and said breech mounting plug have bores of a diameter that are slightly enlarged with respect to the bore of said guide sleeve whereby said rod has a somewhat loose sliding relation therein.

5. An improved cleaning rod device as defined in claim 1 wherein a grip handle of enlarged diameter is removably secured to and is rotatably mounted with respect to a back end portion of said cleaning rod.

6. An improved cleaning rod device as defined in claim 1 wherein, said cleaning rod is of sectioned construction having a central part, a back end part and a bore conditioning part that are threadably-removably secured together, said back end part has a rotatable hand grip portion, and said central part is provided in different lengths to accommodate said cleaning rod to different lengths of gun bores.

7. An improved cleaning rod device as defined in claim 6 wherein said bore conditioning part is provided in different sizes to accommodate said part to different sizes of gun bores.

8. An improved cleaning rod device as defined in claim 1 wherein a back end portion of said rod is of enlarged diameter with respect to said front end portion to abut said guide sleeve and limit maximum forward cleaning movement of said rod to prevent said conditioning element from moving out of the muzzle end of the gun bore, and a grip handle is secured on said back end portion.

9. An improved cleaning rod device as defined in claim 8 wherein said grip handle is rotatably secured on said back end portion of said rod to permit turning movement of said rod and said conditioning element during their movement along the gun bore.

10. An improved cleaning rod device as defined in claim 1 wherein the bore of said guide sleeve has a close clearance defining relation with respect to said rod to prevent play movement therebetween when said rod is moved back and forth along the gun bore, and said rod has a back end shoulder adapted to be moved into abutment with said guide sleeve to limit maximum forward movement of said rod within the guide bore during a bore cleaning operation of the device.

11. An improved cleaning rod device as defined in claim 1 wherein, the bores of said breech mounting plug and of said carrier sleeve have a somewhat wide clearance defining relation with said cleaning rod and said guide sleeve has a bore defining a close clearance defining relation with said rod, whereby said rod is primarily restricted as to sidewise movement during its back and forth operation by and between the bore of said guide sleeve and the outer diameter of said bore conditioning element.

12. An improved cleaning rod device as defined in claim 8 wherein said grip handle, said breech mounting front plug, said positioning sleeve, said means cooperating with said carrier sleeve to positively retain said breech mounting plug in an abutting position with respect to the breech of a gun to be cleaned which is a position retention sleeve and said guide sleeve are of plastic material construction, and said cleaning rod and said carrier sleeve are of metal construction.

13. An improved cleaning rod device as defined in claim 11 wherein, said positioning sleeve has a back end open mouth portion, and said guide sleeve is slidably-removably fit within said back end open mouth portion.

14. An improved cleaning rod device as defined in claim 13 wherein said rod has a back end portion of an enlarged diameter that defines an abutment shoulder to engage said guide sleeve and limit the maximum forward advance of said rod within the bore of the gun being cleaned.

15. An improved cleaning rod device as defined in claim 1 wherein said means is a position retention sleeve mounted on said carrier sleeve for sliding movement thereon between said breech mounting front plug and said rear positioning sleeve, and said position retention sleeve has an outwardly extended set screw which is adapted on rotation of said position retention sleeve on said carrier sleeve to move into a notch in the stock of the gun.

16. An improved cleaning rod device which comprises, a longitudinally extending substantially rigid cleaning rod adapted to receive a gun-cleaning element on a front end thereof and to be introduced into the bore of the gun from its breech end, a substantially rigid carrier sleeve adapted to slidably receive said rod for back and forth sliding movement therealong, a breech mounting front plug secured on a front end portion of said carrier sleeve and adapted to abut the breech end of the gun barrel, a rear positioning sleeve assembly mounted on aback end portion of said carrier sleeve, said rod having an enlarged back end portion adapted to be moved into abutment with said rear positioning sleeve assembly to limit forward movement of said rod whereby the gun-cleaning element is retained within the gun bore during a cleaning operation thereof, a position retention sleeve slidably adjustably mounted on said carrier sleeve and having means for locking it in a position on said carrier sleeve against an inner side of a cross bridge of the gun to retain said breech mounting plug in abutment with the breech end of the gun barrel and thus positively retain the device in a fixed position during reciprocating movement of said rod for cleaning the gun bore.

17. An improved cleaning rod as defined in claim 1 wherein said positioning sleeve assembly has a removable fitted-in part of a length determined by the desired length of forward cleaning movement of said rod within the gun bore.

18. An improved cleaning rod device as defined in claim 16 wherein a grip handle of enlarged diameter is mounted on a back end portion of said cleaning rod.

19. An improved cleaning rod device as defined in claim 18 wherein said grip handle has means for rotatably mounting it on a back end of said cleaning rod.

* * * * *